US007916091B2

(12) United States Patent
Chang et al.

(10) Patent No.: US 7,916,091 B2
(45) Date of Patent: Mar. 29, 2011

(54) ANTENNA MODULE FOR A WIRELESS ELECTRONIC DEVICE

(75) Inventors: I-Huang Chang, Kaohsiung (TW); Hung-Hsien Chiu, Hsinchu (TW)

(73) Assignee: Wha Yu Industrial Co., Ltd., Hsinchu (TW)

( * ) Notice: Subject to any disclaimer, the term of this patent is extended or adjusted under 35 U.S.C. 154(b) by 349 days.

(21) Appl. No.: 12/237,352

(22) Filed: Sep. 24, 2008

(65) Prior Publication Data

US 2009/0015511 A1 Jan. 15, 2009

Related U.S. Application Data

(63) Continuation-in-part of application No. 11/324,391, filed on Jan. 4, 2006, now abandoned.

(30) Foreign Application Priority Data

Feb. 5, 2005 (TW) ..... 94103977 A

(51) Int. Cl.
*H01Q 1/24* (2006.01)

(52) U.S. Cl. ..... 343/702; 343/700 MS

(58) Field of Classification Search ..... 343/702, 343/700 MS, 893, 725
See application file for complete search history.

(56) References Cited

U.S. PATENT DOCUMENTS

| | | | | |
|---|---|---|---|---|
| 2003/0076265 | A1* | 4/2003 | Chen | 343/702 |
| 2003/0112188 | A1* | 6/2003 | Bordi et al. | 343/702 |
| 2004/0085248 | A1* | 5/2004 | Onaka et al. | 343/702 |
| 2004/0145521 | A1* | 7/2004 | Hebron et al. | 343/700 MS |
| 2010/0271270 | A1* | 10/2010 | Sung et al. | 343/702 |

* cited by examiner

*Primary Examiner* — HoangAnh T Le
(74) *Attorney, Agent, or Firm* — Egbert Law Offices PLLC

(57) ABSTRACT

The antenna module fabrication for a wireless electronic device includes setting up the antenna and the assembly base that is to connect the antenna to the designated circuit board. The antenna and the assembly base are two independent pieces, and the positioning parts are for positioning so that the antenna and assembly base are one body. The antenna module of the invention can achieve the advantages such as simple production, cost effectiveness, prevention of the antenna module from deforming and quality improvement.

3 Claims, 9 Drawing Sheets

ANTENNA MODULE FOR A WIRELESS ELECTRONIC DEVICE

CROSS-REFERENCE TO RELATED U.S. APPLICATIONS

The present application is a continuation-in-part of U.S. application Ser. No. 11/324,391, filed on Jan. 4, 2006, and entitled "ANTENNA MODULE FABRICATION METHOD FOR A WIRELESS ELECTRONIC DEVICE", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an antenna module fabrication method for wireless electronic devices, and more particularly to an antenna module with an assembly connection between the antenna and assembly base.

2. Description of Related Art Including Information Disclosed Under 37 CFR 1.97 and 37 CFR 1.98.

The signal transmitting and receiving functions of wireless electronic product must be done by antennas to reach an expected effect. The antenna for the traditional wireless electronic product looks protruding on the outside, and it is usually extended to the designated circuit board on the inside. However, with today's wireless electronic product being thin and short, the style and fabrication method for a traditional antenna is outdated, especially with the many handheld or portable electronic products, such as PDA, notebook computers, handheld wireless game consoles or other portable wireless electronic devices. When the size of the electronic products has become smaller and thinner, the traditional antenna that protrudes will look too awkward, and the protruding end of the antenna is not convenient for the electronic products to be carried in the pocket. Moreover, because the wireless electronic devices become smaller, the space inside is very limited. If the antenna is connected electrically by the wire to the circuit board inside the machine, it will cause the wire allocation inside the devices to be more and more complicated.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

Because of the characteristics of the antenna 10 30 60 70 being small and thin, its shape is easy to be changed by pressure or outer force, and the performance of the signal transmitting and receiving is greatly affected thereby. After assembling the assembly base 20 and the antenna 10 30 60 70, the support and reinforcement of the assembly base 20 makes the antenna 10 30 60 70 hard to change shape. During the production of assembling the circuit board, the reinforcement of the assembly base 20 prevents the antenna 10 30 60 70 from changing shapes. Therefore, the assembling production of the antenna 10 30 60 70 and circuit board 50 becomes easier, and largely reduces the defective rate and cost, which meets the economical benefit.

The antenna and the circuit board 50 of the present invention can be connected directly by inserting the protruding footing 25 that is on the bottom of the assembly base 20 into the insert hole 51 on the circuit board 50, and by connecting the two bent edges 11 12 of the antenna 10 to the designated area on the circuit board 50. Therefore, the antenna 10 and the circuit board 50 is connected electronically; under the circumstances, the indirect electrical connection from the wire and circuit board 50 is not needed. The special structure of the antenna 10 and assembly base 20 of the present invention can use surface mount technology to connect to the circuit board, which can improve the production speed and the quality. Therefore, the present invention meets the demand of the wireless electronic devices being small and thin, and the antenna module of the present invention becomes better in resolving the issues created from the conventional wireless electronic device that has a protruding antenna. The antenna module of the present invention does not need extra wire to connect circuit board 50 in the limited space inside the wireless electronics to achieve the best signal transmitting and receiving effect, and it meets industrial practicability such as easy assembly and not taking too much room.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
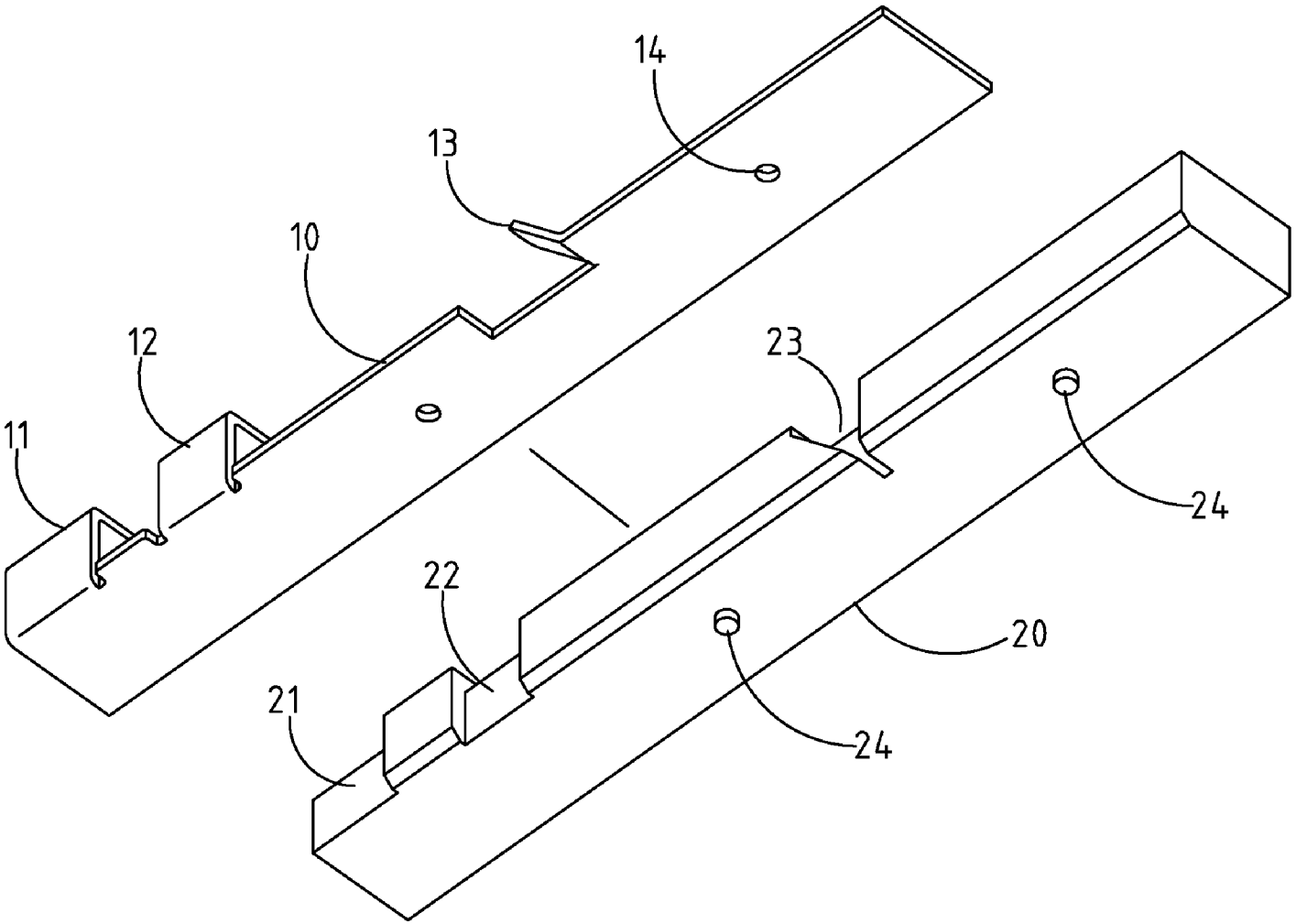
FIG. 1 shows an exploded perspective view of the first embodiment of the antenna.
Figure 2:
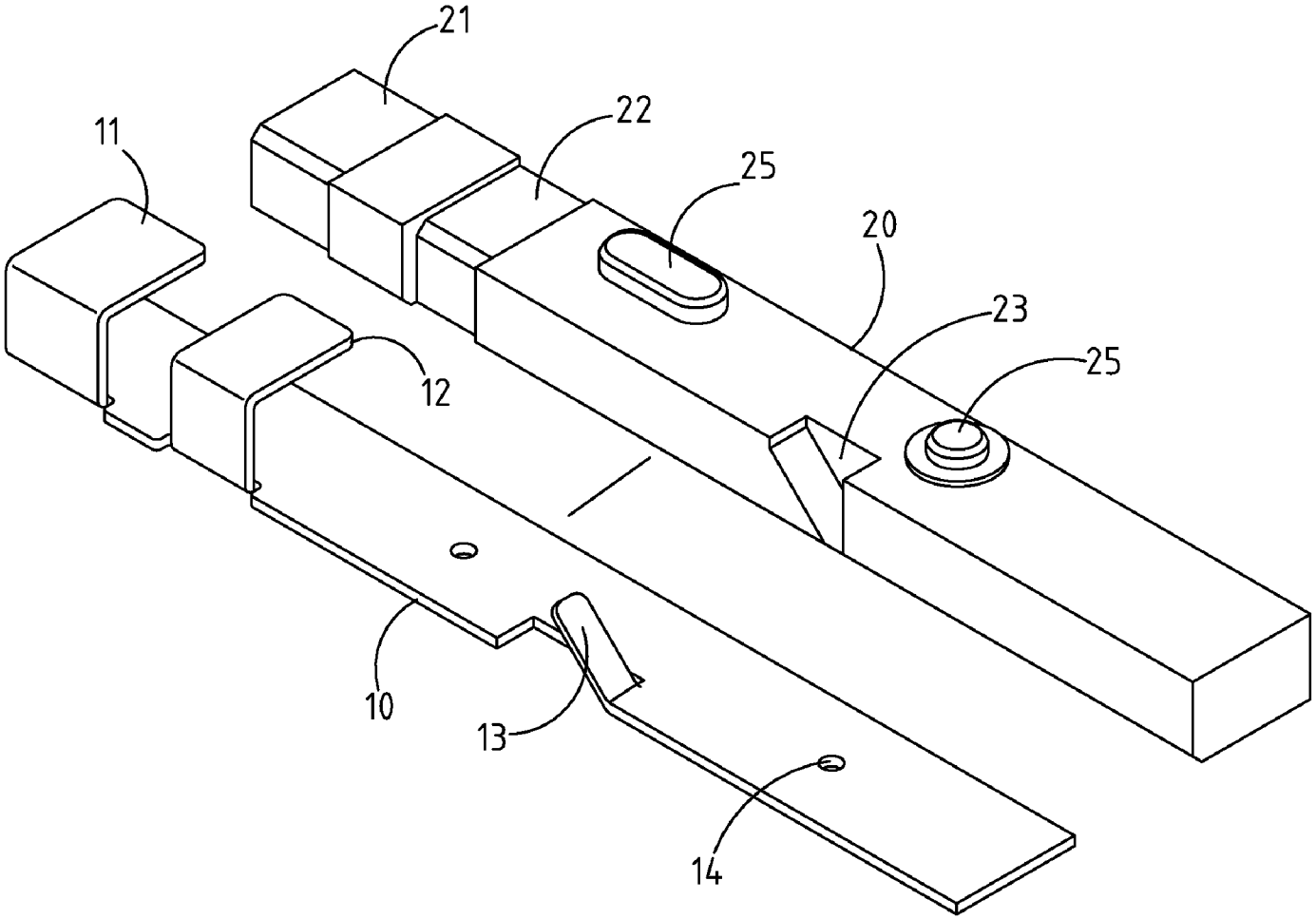
FIG. 2 shows an exploded perspective view of the first embodiment of the antenna from another view angle.
Figure 3:
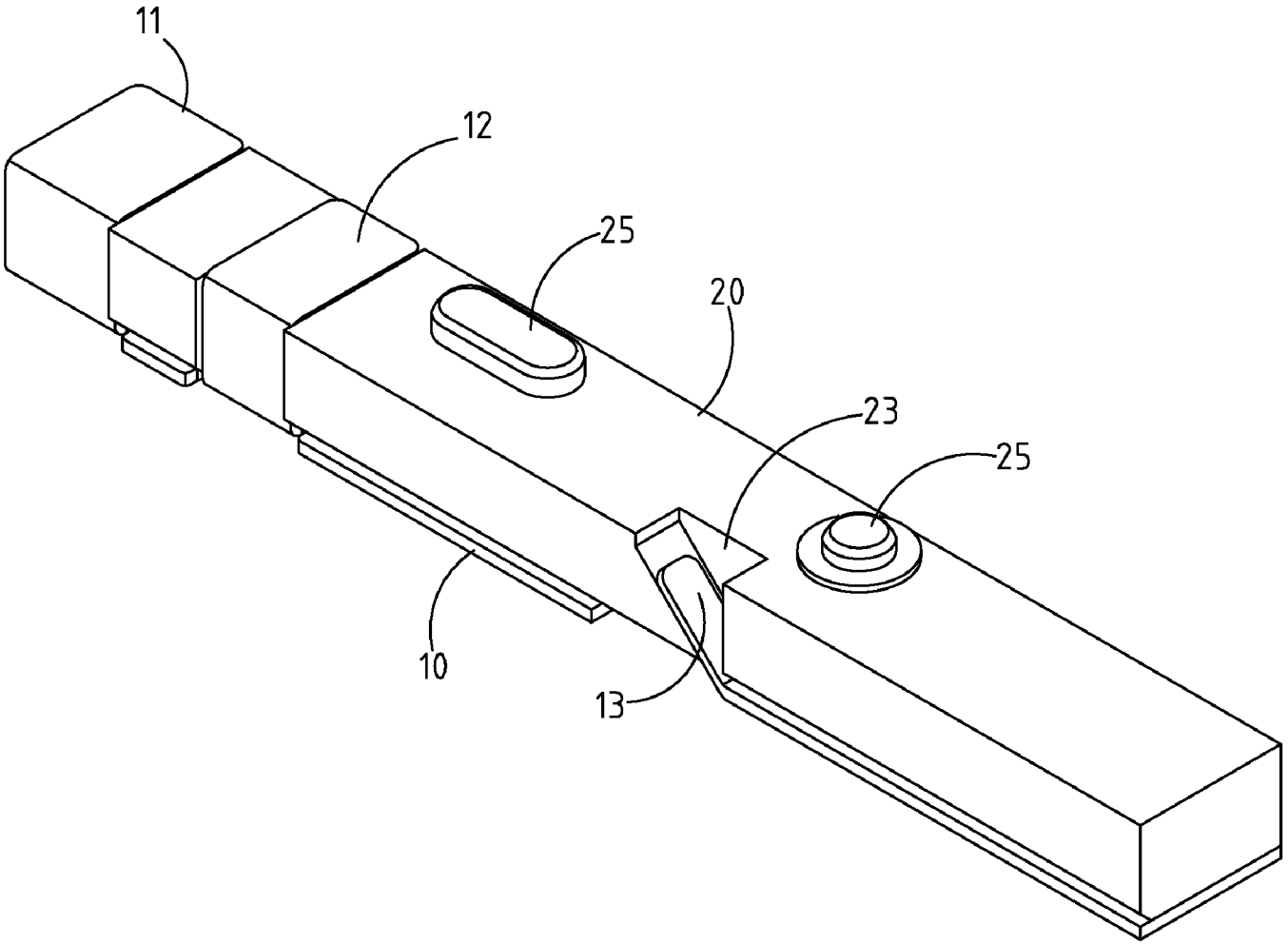
FIG. 3 shows an assembled perspective view of the components revealed in FIG. 2.

As shown in FIGS. 1-3, there is a preferred embodiment of the antenna module for wireless electronic device.

The antenna 10 is a long metal plate. One end of the antenna has two bent edges 11 12 that are spaced and shaped almost the same, and the middle of the antenna 10 forms a positioning part 13 that protrudes to one side. The antenna's 10 long plate has holes 14 that are spaced apart. The assembly base 20 is a long block that is made of insulation material. One of its ends has two spaced concave edges 21 22 for the two bent edges 11 12 of the antenna 10 to set in, and, in the middle of the assembly base 20, has an oblique slot 23 for the positioning part 13 that is located in the middle of the antenna to set in, and, on the other side of the assembly base 20, has protruding columns 24 for the through holes 14 of the antenna to go through. By the design of the above-mentioned parts, the antenna 10 and the assembly base 20 can be connected as one piece.

Figure 5:
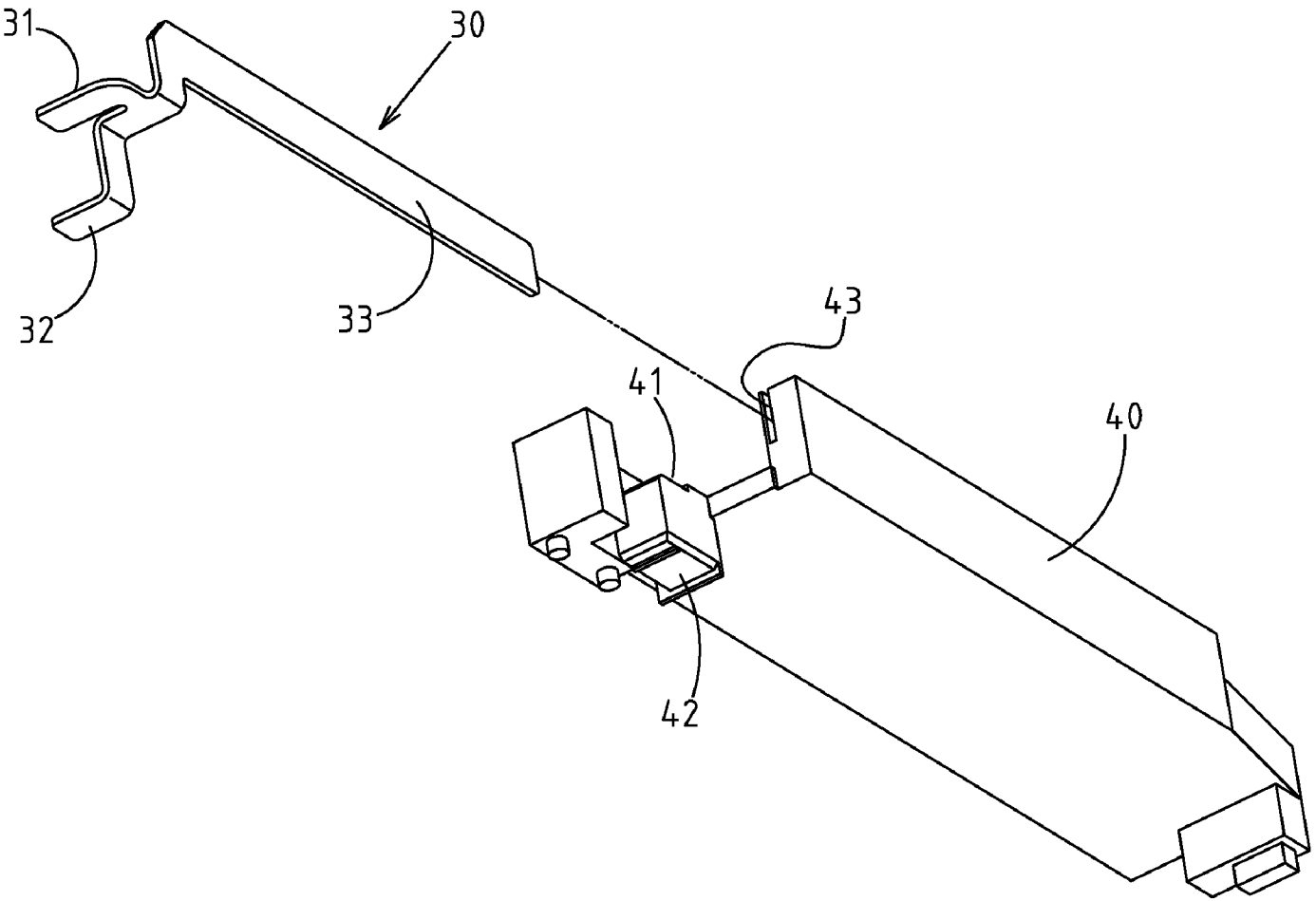
FIG. 5 shows an exploded perspective view of the second embodiment of the antenna.
Figure 6:
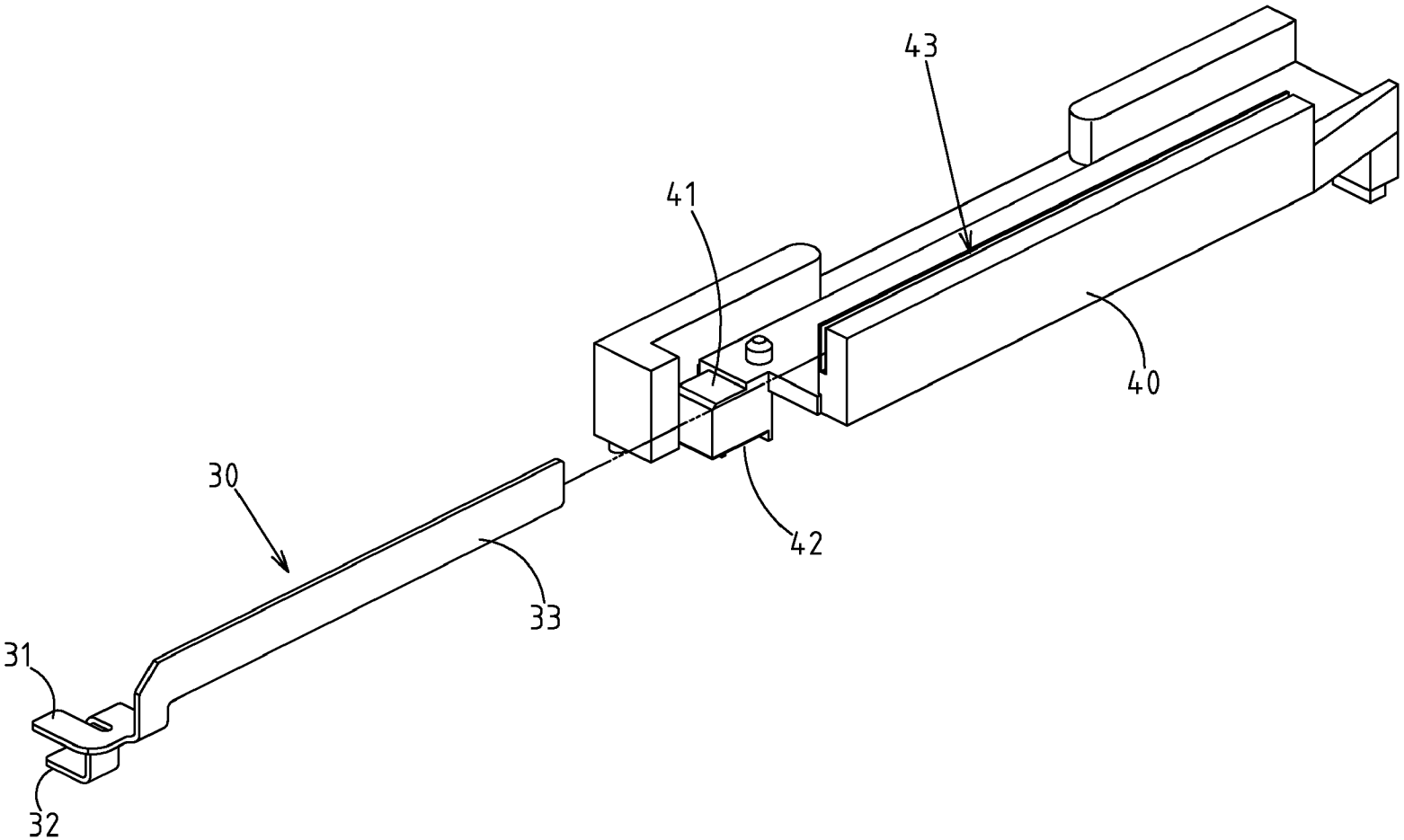
FIG. 6 shows an exploded perspective view of the second embodiment of the antenna from another view angle.
Figure 7:
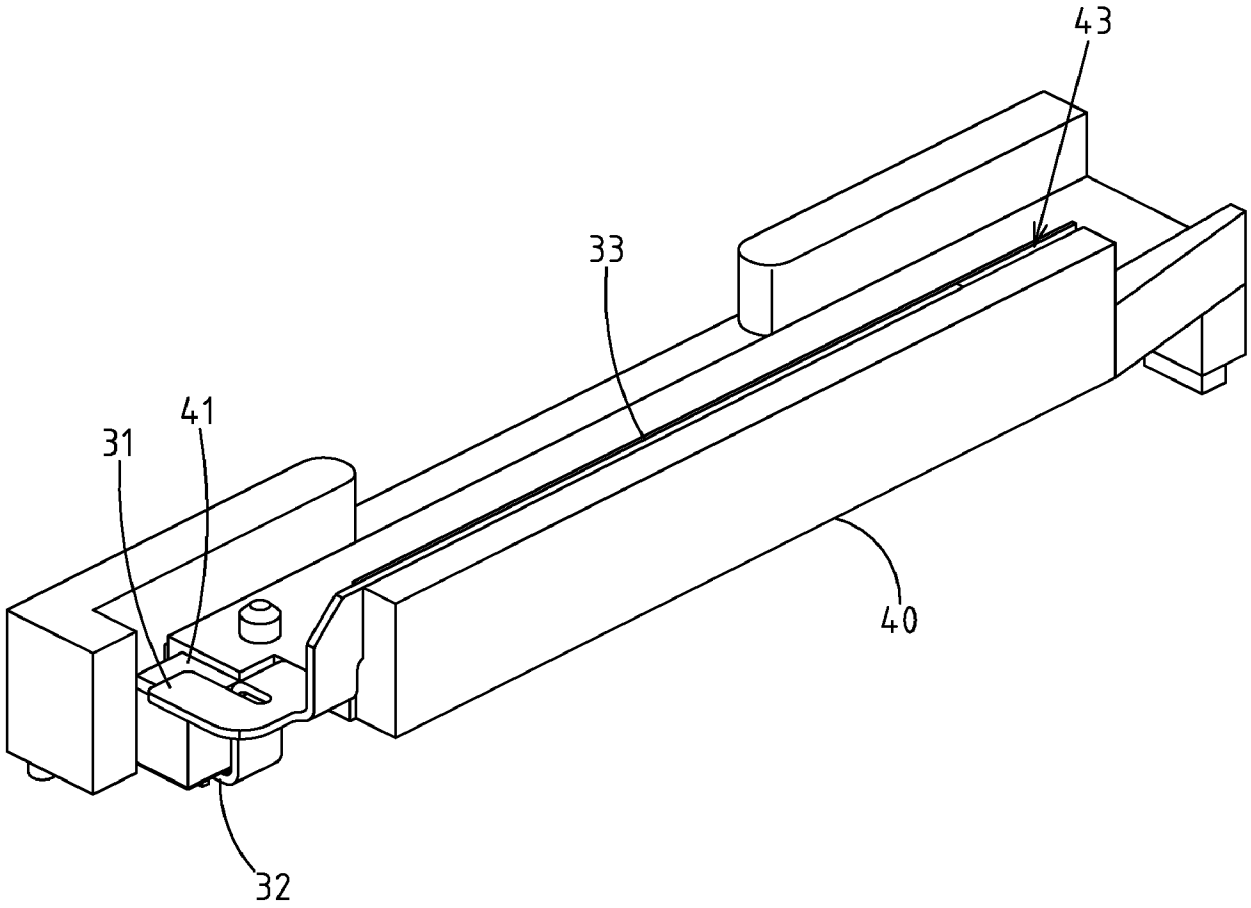
FIG. 7 shows an assembled perspective view of the components revealed in FIG. 6.

FIGS. 5, 6 and 7 show the second embodiment of an antenna module for a wireless electronic device. The antenna 30 is a long metal plate; one end forms upper and lower bent edges 31 32; and the upper and lower bent edges and the long plate 33 of the antenna 30 are placed vertically. The assembly base 40 is a long block that is made of insulation material, and one of its ends has upper and lower concave edges 41 42 for the upper and lower bent edge 31 32 of the antenna 30 to set in. A long and narrow groove 43 is placed on a section of the assembly base 40, which is for the entire long plate 33 of the antenna to insert in. By the design of the above mentioned parts, the antenna 30 and the assembly base 40 can be connected as one piece as well.

Figure 8:
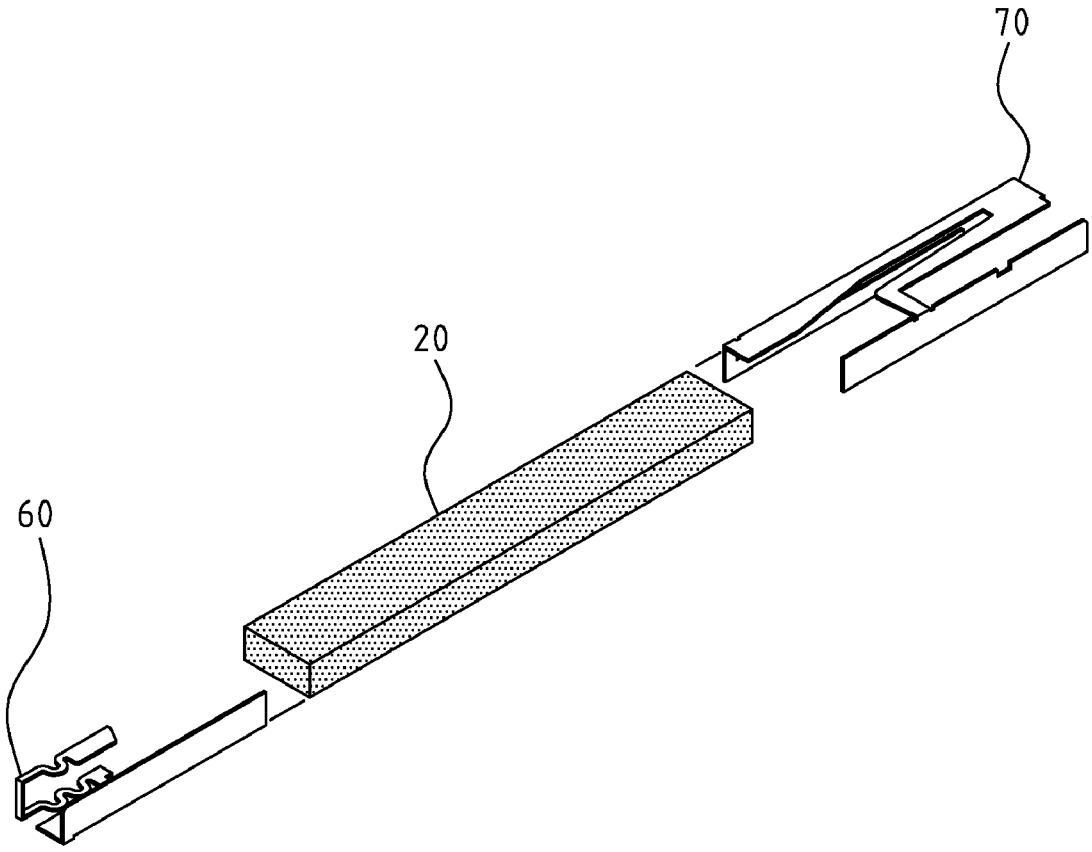
FIG. 8 shows an exploded perspective view of the third embodiment of the antenna.
Figure 9:
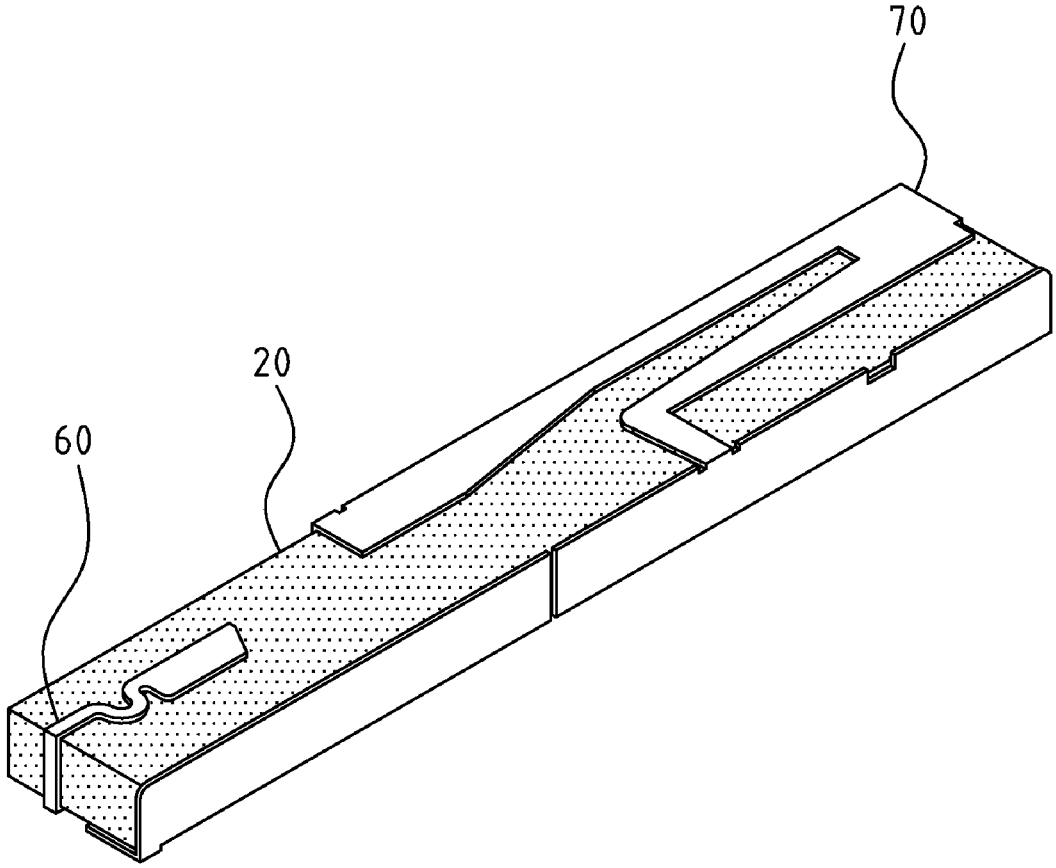
FIG. 9 shows an assembled perspective view of the third embodiment of the antenna.

FIGS. 8 and 9 show the third embodiment of an antenna module for wireless electronic device being comprised of at least two antennas 60 70 for working in different frequency and an assembly base 20. The assembly base 20 is a long block that is made of insulation material for positioning said two antennas as one body.

By revealing the two embodiments mentioned above, it proves that the antenna and assembly base of the present invention can indeed be connected as one piece, and the assembly of the parts can be very diversified. At least the above-mentioned embodiments have revealed the positioning methods such as holes and columns, inserting and locking. Of course, the antenna 10 and the assembly base 20 can be glued as one piece; and the antenna 10 and the assembly base 20 can be connected as one piece by molding.

The description of the antenna module fabrication of the present invention is as follows:

a) make an antenna and an assembly base separately, and make corresponding positioning parts on the antenna and assembly base; and b) take the positioning parts mentioned above, and connect the antenna and the assembly base as one to make the antenna module.

Figure 4:
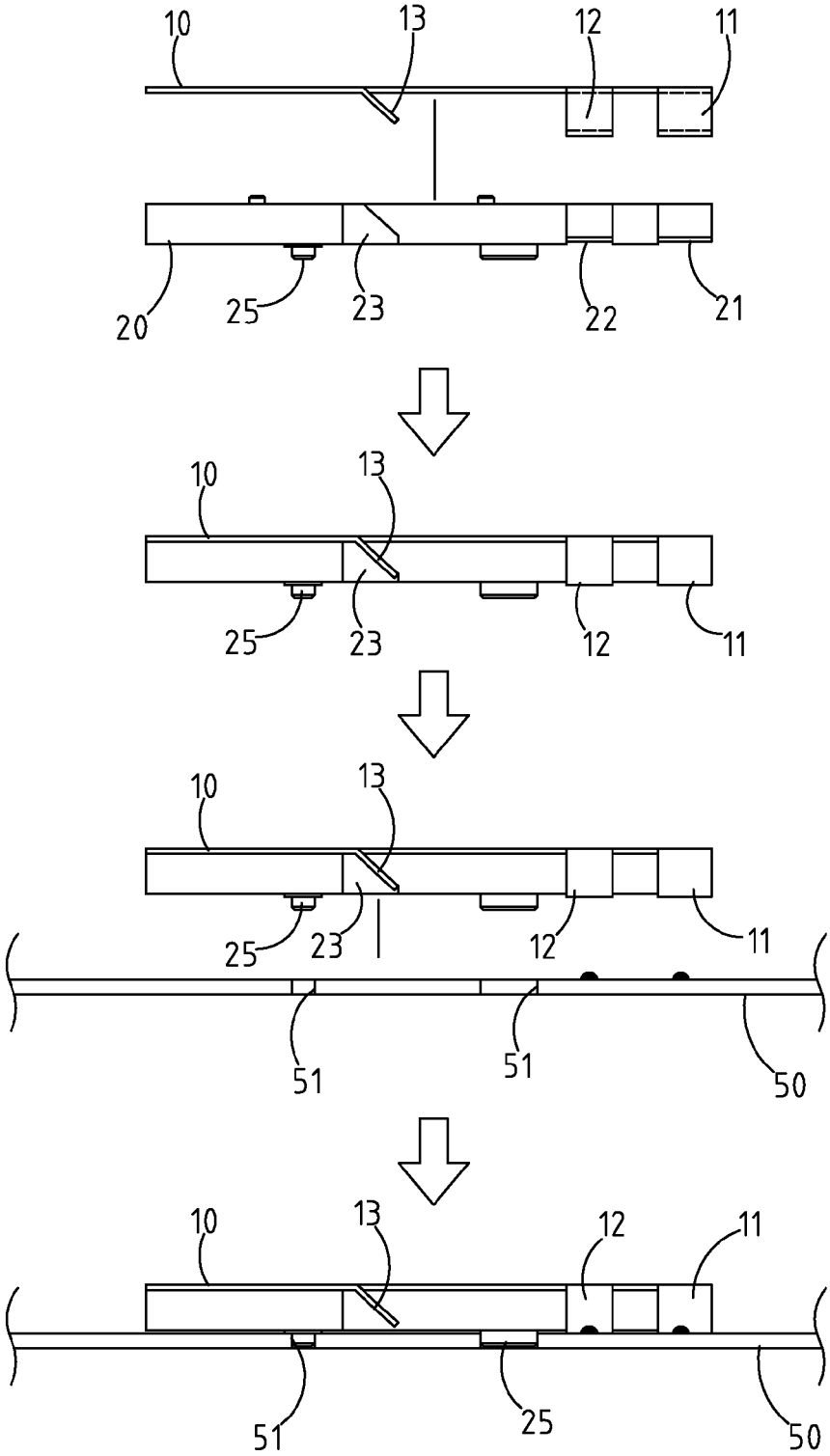
FIG. 4 shows the schematic view of the antenna module assembly process.

As for assembling the assembly base to the circuit board as mentioned in the first embodiment, FIG. 4 shows a protruding footing 25 that is placed on one side of the assembly base 20, which can be inserted into the inset hole 51 on the circuit board 50. The two bent edges 11 12 of the antenna 10 can be connected electrically to the designated location on the circuit board 50.

An antenna module and circuit board fabrication method for a wireless electronic device has an antenna 10 and an assembly base 20, a corresponding positioning part being placed thereon. By coordinating the positioning parts 13 mentioned above to make the antenna module that is made of an antenna 10 and an assembly base 20, the two bent edges 11 12 of the antenna 10 are located on the outside of the assembly base 20. The embodiment of the present invention mainly is to remove the protruding footing 25 that is on one side of the assembly base 20, and the insert hole 51 on the circuit board 50, and to connect the antenna module to the circuit board by the surface mount technology.

An antenna module fabrication method for wireless electronic device, includes: setting up an antenna; placing the antenna into the mold; injecting the plasticity material into the mold to form an assembly base; forming a composite of the antenna into one piece to form a one-piece antenna module; and connecting the antenna module to the circuit board by the surface mount technology.

We claim:

1. An antenna module for a wireless electronic device, comprising:

an antenna having one end with two bent edges spaced and shaped similarly and a middle portion forming a positioning part protruded to one side thereof, said antenna being comprised of a plate with holes spaced apart; and an assembly base, having one end with two spaced concave edges engaging said two bent edges of said antenna and a middle portion with an oblique slot engaging said positioning part of said middle portion of said antenna, said assembly base having protruding columns on another side thereof, said protruding columns being cooperative with said holes in the said plate of said antenna.

2. The antenna module for a wireless electronic device defined in claim 1, wherein one end of the antenna forms upper and lower bent edges, the upper and lower bent edges and said plate being placed vertically, wherein one end of said assembly base has upper and lower concave edges engaging the upper and lower bent edge of said antenna, said assembly base having a groove placed on a section thereof, engaging said plate of said antenna.

3. The antenna module for a wireless electronic device defined in claims 1, further comprising:

a second antenna at a frequency different from said antenna; and a second assembly base positioning the two antennas as one body.

* * * * *